US009828872B2

(12) United States Patent
Lacy et al.

(10) Patent No.: US 9,828,872 B2
(45) Date of Patent: Nov. 28, 2017

(54) COOLING STRUCTURE FOR TURBOMACHINE

(71) Applicant: General Electric Company, Schenectady, NY (US)

(72) Inventors: Benjamin Paul Lacy, Greer, SC (US); Brian Peter Arness, Simpsonville, SC (US); David Edward Schick, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1202 days.

(21) Appl. No.: 13/761,318

(22) Filed: Feb. 7, 2013

(65) Prior Publication Data

US 2014/0219780 A1 Aug. 7, 2014

(51) Int. Cl.

| | |
|---|---|
| ***F04D 31/00*** | (2006.01) |
| ***F01D 25/12*** | (2006.01) |
| *F01D 11/24* | (2006.01) |

(52) U.S. Cl.

CPC ..... *F01D 25/12* (2013.01); *F01D 11/24* (2013.01); *F05D 2240/11* (2013.01); *F05D 2240/81* (2013.01); *F05D 2260/22141* (2013.01)

(58) Field of Classification Search

CPC ..... F01D 11/08; F01D 25/12; F01D 25/14; F01D 5/30; F01D 11/005; F01D 11/006; F01D 11/008; F01D 25/08; F01D 11/24; F01D 5/187; F01D 5/188; F05D 2240/81; F05D 2260/22141

USPC ..... 415/115, 116, 138, 139, 214.1; 416/193 A, 95, 96 R, 97 R, 191

See application file for complete search history.

(56) References Cited

U.S. PATENT DOCUMENTS

| | | | | |
|---|---|---|---|---|
| 4,902,198 | A * | 2/1990 | North | F01D 9/04 415/115 |
| 5,957,657 | A | 9/1999 | Akita et al. | |
| 6,270,311 | B1 * | 8/2001 | Kuwabara | F01D 11/005 415/110 |
| 6,461,107 | B1 | 10/2002 | Lee et al. | |
| 6,499,949 | B2 | 12/2002 | Schafrik et al. | |
| 6,511,762 | B1 | 1/2003 | Lee et al. | |
| 6,551,061 | B2 | 4/2003 | Darolia et al. | |
| 6,599,568 | B2 | 7/2003 | Lee et al. | |
| 6,617,003 | B1 | 9/2003 | Lee et al. | |
| 7,363,707 | B2 | 4/2008 | Powers | |
| 7,527,475 | B1 | 5/2009 | Liang | |
| 7,641,445 | B1 | 1/2010 | Liang | |

(Continued)

*Primary Examiner* — Craig Kim
*Assistant Examiner* — Jason Mikus
(74) *Attorney, Agent, or Firm* — Ernest G. Cusick; Hoffman Warnick LLC

(57) ABSTRACT

A cooling structure for a turbomachine. In one embodiment, the cooling structure is for a seal slot of the turbomachine. The cooling structure includes a body coupled to a surface of the seal slot. The body includes a passageway on a first surface of the body for providing a cooling fluid to the seal slot. In an other embodiment, a apparatus includes a first component and a second component adjacent the first component. The apparatus also includes a seal slot extending between the first component and the second component, and a cooling structure positioned within the seal slot. The cooling structure includes a body coupled to a surface of the seal slot. The body has a passageway on a first surface of the body for providing a cooling fluid to the seal slot.

6 Claims, 13 Drawing Sheets

(56) References Cited

U.S. PATENT DOCUMENTS

| | | | | |
|---|---|---|---|---|
| 7,653,994 | B2 | 2/2010 | Dasilva et al. | |
| 7,695,247 | B1 | 4/2010 | Liang | |
| 7,722,327 | B1 | 5/2010 | Liang | |
| 7,740,445 | B1 | 6/2010 | Liang | |
| 7,857,589 | B1 | 12/2010 | Liang | |
| 7,900,458 | B2 | 5/2011 | James et al. | |
| 7,963,745 | B1 | 6/2011 | Liang | |
| 7,967,566 | B2 | 6/2011 | Liang | |
| 8,382,424 | B1 * | 2/2013 | Liang | F01D 11/006 277/644 |
| 8,784,037 | B2 * | 7/2014 | Durocher | F01D 5/08 164/111 |
| 8,845,285 | B2 * | 9/2014 | Weber | F01D 11/005 415/173.1 |
| 2005/0111966 | A1 * | 5/2005 | Metheny | F01D 5/183 415/116 |
| 2007/0205189 | A1 | 9/2007 | Grossklaus, Jr. et al. | |
| 2009/0255117 | A1 | 10/2009 | Hovel et al. | |
| 2012/0082550 | A1 * | 4/2012 | Harris, Jr. | F01D 5/081 416/95 |
| 2012/0308843 | A1 * | 12/2012 | Ott | B23K 1/0018 428/614 |

* cited by examiner

COOLING STRUCTURE FOR TURBOMACHINE

BACKGROUND OF THE INVENTION

1. Technical Field

The disclosure is related generally to a turbomachine. More particularly, the disclosure is related to a cooling structure for a turbomachine.

2. Related Art

Conventional turbomachines (e.g., gas turbine, steam turbine) are frequently utilized to generate power. More specifically, a working fluid such as hot gas or steam is conventionally forced across sets of turbomachine blades, which are coupled to the rotor of the turbomachine. The force of the working fluid on the blades causes those blades (and the coupled body of the rotor) to rotate. In many cases, the rotor body is coupled to the drive shaft of a dynamo-electric machine such as an electric generator. In this sense, initiating rotation of the turbo-machine rotor can initiate rotation of the drive shaft in the electric generator, and cause that generator to generate an electrical current (associated with power output).

The working fluid in these conventional turbomachines can flow through the turbomachines at high temperatures. The operational efficiency of the conventional turbomachine may be increased by maintaining the working fluid within the turbomachine and/or preventing specific components of the turbomachine from being exposed to the high temperature working fluid. For example, Turbomachine seals may be used to help maintain the working fluid within the turbomachine and/or preventing undesirable exposure of the working fluid within the turbomachine. However, cooling channels are often used adjacent the seals within the turbomachines. Specifically, the cooling channels may be used to cool the areas of the turbomachine surrounding the seals that are exposed to the high temperature working fluid. These cooling channels are often expensive to manufacture and difficult to install on components within the turbomachine.

BRIEF DESCRIPTION OF THE INVENTION

A cooling structure for a turbomachine is disclosed. In one embodiment, the cooling structure is for a seal slot of a turbomachine. The cooling structure includes: a body coupled to a surface of the seal slot, the body including a passageway on a first surface of the body for providing a cooling fluid to the seal slot.

A first aspect of the invention includes a cooling structure for a seal slot of a turbomachine. The cooling structure includes: a body coupled to a surface of the seal slot, the body including a passageway on a first surface of the body for providing a cooling fluid to the seal slot.

A second aspect of the invention includes an apparatus having: a first component; a second component adjacent the first component; a seal slot extending between the first component and the second component; and a cooling structure positioned within the seal slot, the cooling structure including a body coupled to a surface of the seal slot, the body including a passageway on a first surface of the body for providing a cooling fluid to the seal slot.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
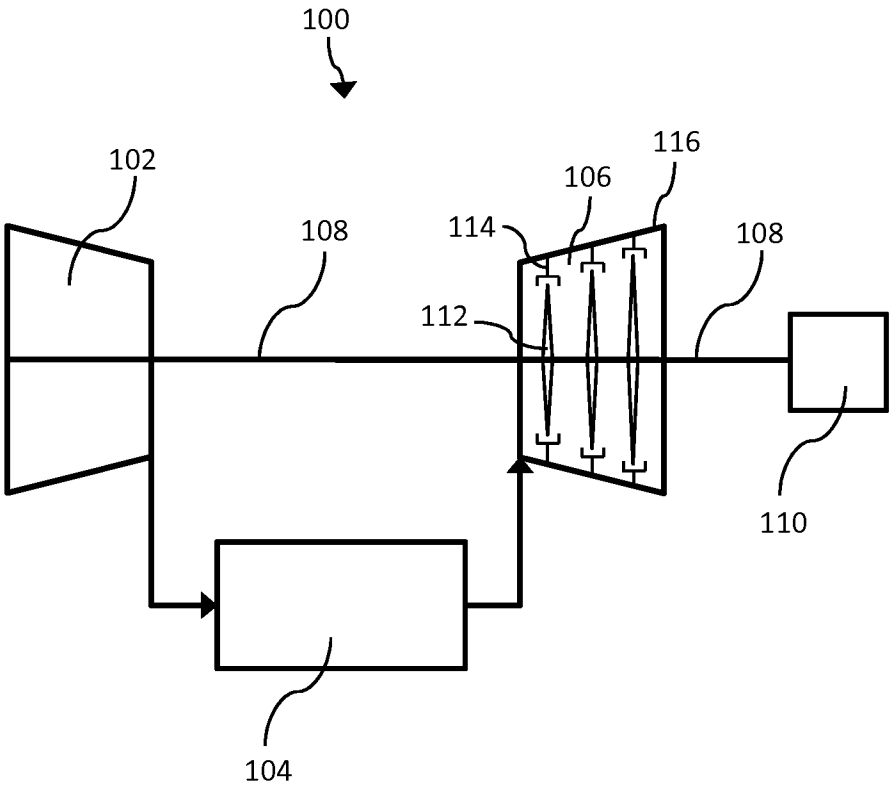
FIG. 1 shows a schematic depiction of a turbomachine, according to embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As described herein, aspects of the invention relate to a turbomachine. Specifically, as described herein, aspects of the invention relate to a cooling structure for a turbomachine.

Turning to FIG. 1, a schematic depiction of a turbomachine is shown according to embodiments of the invention. Turbomachine 100, as shown in FIG. 1 may be a conventional gas turbine system. However, it is understood that turbomachine 100 may be configured as any conventional turbine system (e.g., steam turbine system) configured to generate power. As such, a brief description of the turbomachine 100 is provided for clarity. As shown in FIG. 1, turbomachine 100 may include a compressor 102, combustor 104 fluidly coupled to compressor 102 and a gas turbine component 106 fluidly coupled to combustor 104 for receiving a combustion product from combustor 104. Gas turbine component 106 may also be coupled to compressor 102 via shaft 108. Shaft 108 may also be coupled to a generator 110 for creating electricity during operation of turbomachine 100.

During operation of turbomachine 100, as shown in FIG. 1, compressor 102 may take in air and compress the inlet air before moving the compressed inlet air to the combustor 104. Once in the combustor 104, the compressed air may be mixed with a combustion product (e.g., fuel) and ignited. Once ignited, the compressed air-combustion product mixture is converted to a hot pressurized exhaust gas (hot gas) that flows through gas turbine component 106. The hot gas flows through gas turbine component 106, and specifically, passes over a plurality of buckets 112 (e.g., stages of buckets) coupled to shaft 108, which rotates buckets 112 and shaft 108 of turbomachine 100. As shaft 108 of turbomachine 100 rotates, compressor 102 and gas turbine component 106 are driven and generator 110 may create power (e.g., electric current).

As discussed herein, the efficiency of turbomachine 100 may be dependent, in part, on the firing temperature within turbomachine 100 during operation. That is, the efficiency of turbomachine 100 may be increased by maintaining a higher temperature of the hot gas flowing through gas turbine component 106. The firing temperature of the hot gas may be maintained, in part, by utilizing a turbine shroud 114 positioned adjacent the tips of blades 112. Shrouds 114 of gas turbine component 106 may prevent axial leakage of the hot gas as it flows through gas turbine component 106. As shown in FIG. 1, shroud 114 may be coupled to housing 116 of gas turbine component 106 and may be positioned adjacent blades 112. In an alternative embodiment, not shown, shroud 114 may be coupled to the tip of each of the blades 112 and may be coupled to one another to form a substantially continuous ring that may rotate with blades 112 for preventing axial leakage of the hot gas within gas turbine component 106.

Figure 2:
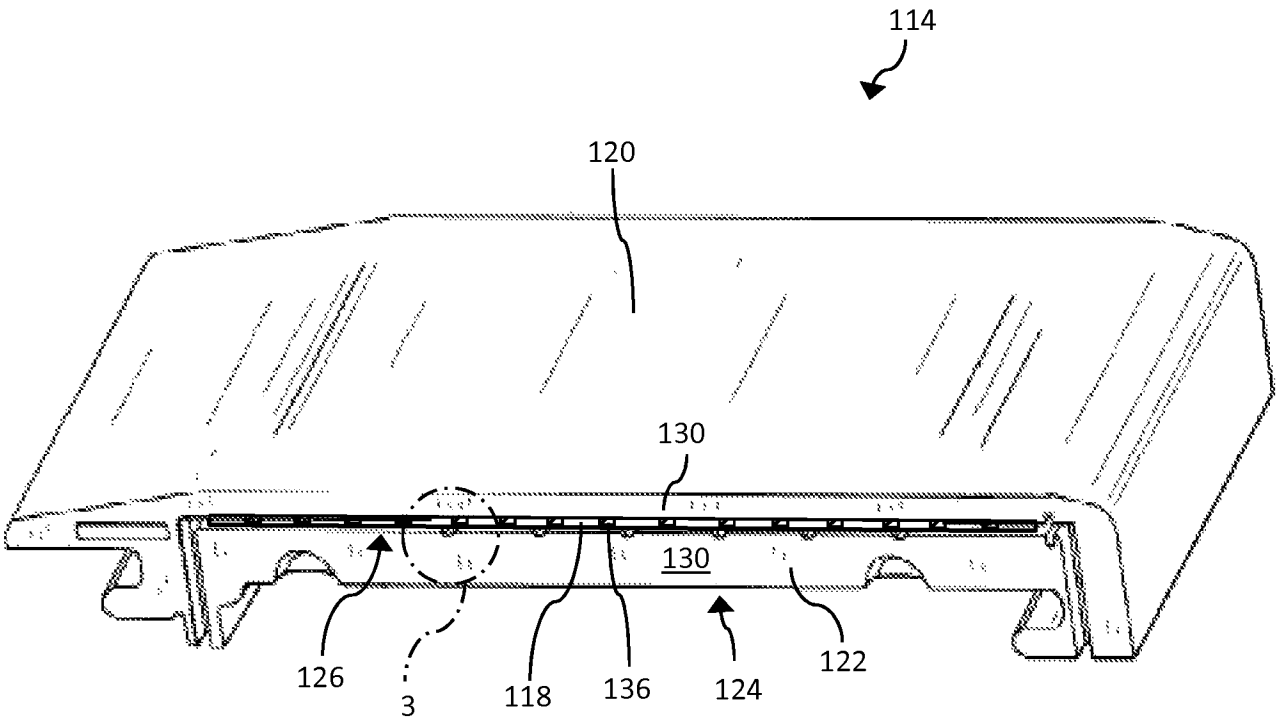
FIG. 2 shows a perspective view of a turbine shroud of a turbomachine including a cooling structure, according to embodiments of the invention.

Turning to FIG. 2, a perspective view of turbine shroud 114 of turbomachine 100 is shown including a cooling structure 118 according to embodiments of the invention. As shown in FIG. 2, turbine shroud 114 may include a first component 120, and a second component 122 positioned adjacent first component 120. In various embodiments, as shown in FIG. 2, second component 122 may include a bottom surface 124 positioned adjacent blades 112 (FIG. 1). Additionally, as shown in FIG. 2, shroud 114 may include a seal slot 126 extending between first component 120 and second component 122. As discussed herein, seal slot 126 may receive a seal 128 (FIG. 4) for substantially preventing hot gas from axially leaking from the hot gas flow path of gas turbine component 106 (FIG. 1). More specifically, seal 128 (FIG. 4) may be positioned within seal slot 126 of shroud 114 and may extend to a distinct turbine shroud (not shown) coupled to a front surface 130 of shroud 114, such that the two coupled shrouds (e.g., shroud 114) and seal 128 positioned therebetween may substantially prevent the hot gas from leaking from the hot gas path of gas turbine component 106 (FIG. 1).

Figure 3:
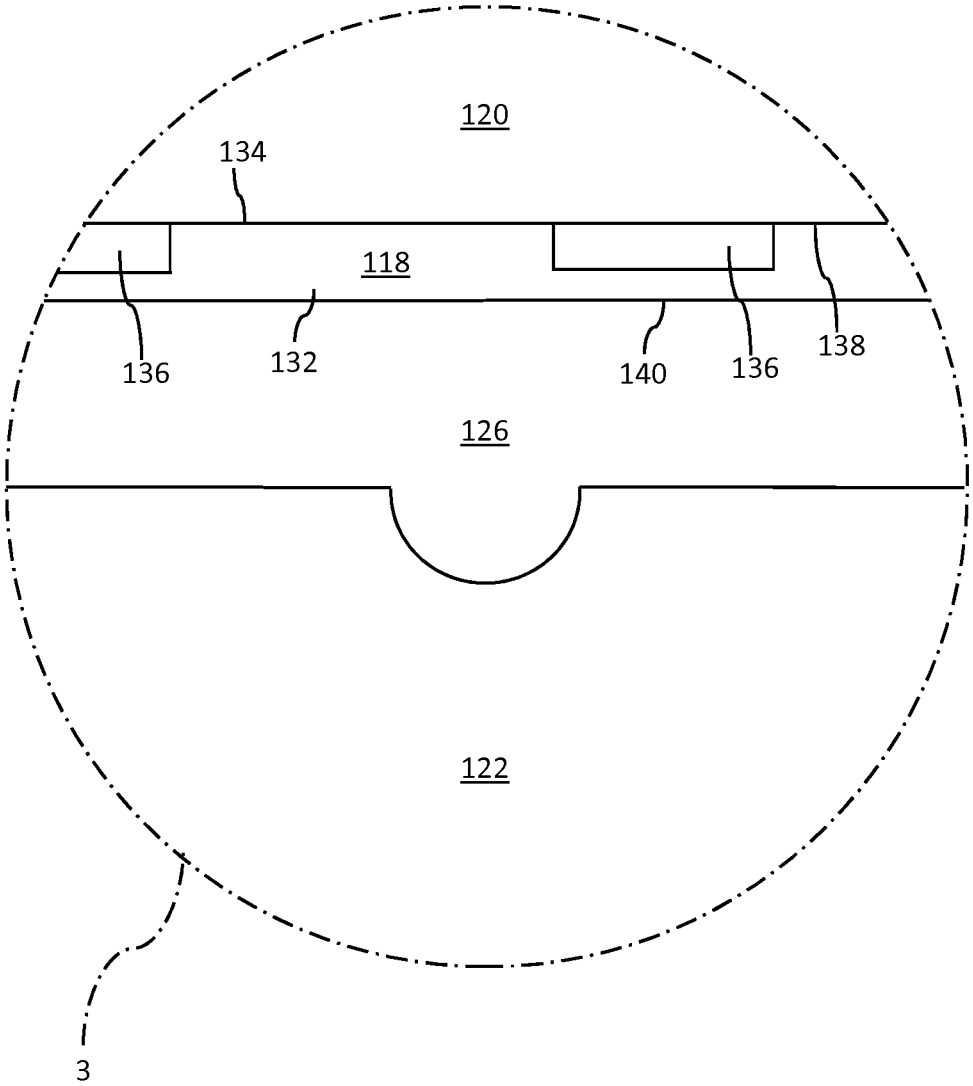
FIG. 3 shows an enlarged front view of a portion of the turbine shroud of the turbomachine in FIG. 2 including the cooling structure, according to embodiments of the invention.
Figure 4:
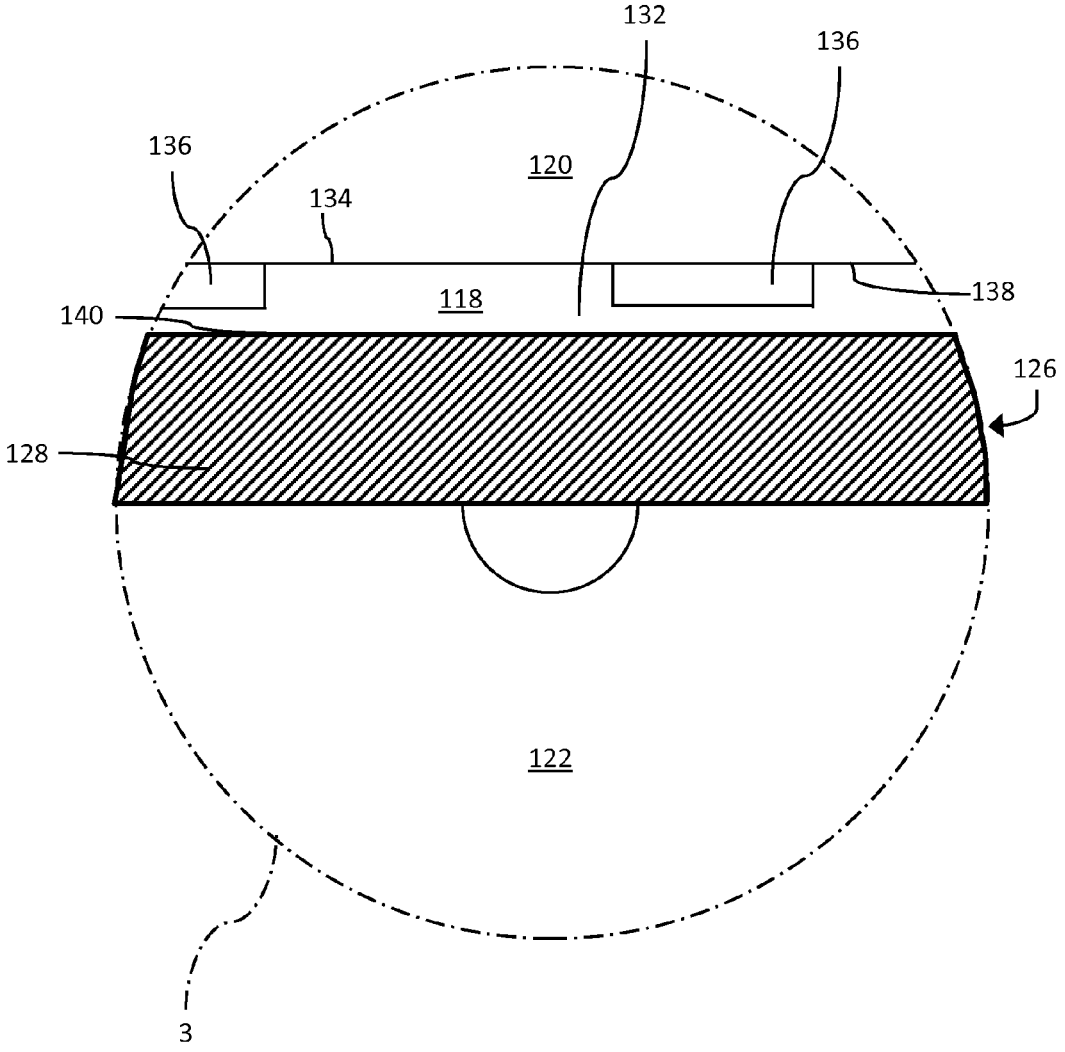
FIG. 4 shows an enlarged front view of a portion of the turbine shroud of the turbomachine in FIG. 2 including the cooling structure and a seal, according to embodiments of the invention.
Figure 5:
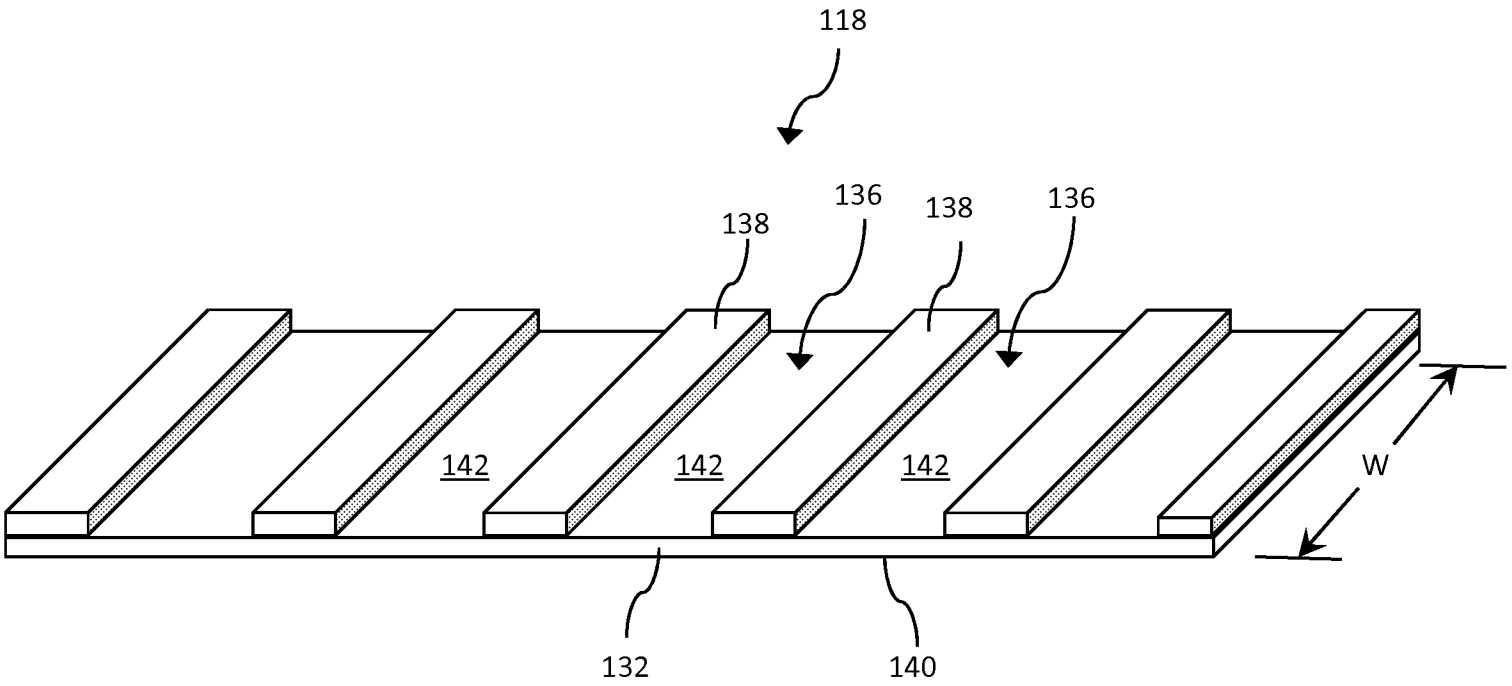
FIG. 5 shows a perspective view of a cooling structure as shown in FIG. 2, according to embodiments of the invention.

Also shown in FIG. 2, shroud 114 may include cooling structure 118 positioned within seal slot 126. More specifically, as shown in FIGS. 3-5, cooling structure 118 may include a body 132 coupled to a surface 134 of seal slot 126, and body 132 may include a passageway 136 on a first surface 138 of body 132. Passageway 136 may provide a cooling fluid to seal slot 126, as described herein. As shown in FIGS. 3 and 4, first surface 138 of body 132 of cooling structure 118 may be coupled to surface 134 of seal slot 126. As shown in FIGS. 3 and 4, first surface 138 of body 132 of cooling structure 118 is coupled to surface 134 of seal slot 126 by brazing. In an alternative embodiment, not shown, first surface 138 of body 132 of cooling structure 118 is coupled to surface 134 of seal slot 126 by any conventional mechanical coupling technique, including, but not limited to, welding, diffusion bonding or mechanical fastening. Also, as shown in FIG. 4, seal 128 may be positioned within seal slot 126 adjacent to and substantially contacting securing cooling structure 118 positioned within seal slot 126. More specifically, seal 128 may be positioned within seal slot 126, adjacent cooling structure 118, such that seal 128 is positioned between second component 122 of shroud 114 and a second surface 140 of cooling structure 118. As a result, passageway 136 of cooling structure may be formed between first surface 138 of body 132 and surface 134 of first component 120 of shroud 114.

As shown in FIGS. 5-11, cooling structure 118 may include a pre-sintered preform. That is, cooling structure 118 may be formed from a pre-sintered preform, manufactured separate from shroud 114, and positioned within seal slot 126 in a separate manufacturing process (e.g., brazing). In an alternative embodiment, not shown, cooling structure 118 may be formed from any conventional metal or metal alloy capable of providing a cooling fluid to seal slot 126 and/or withstanding the high temperature of the hot gas within gas turbine component 106 (FIG. 1) including, but not limited to, aluminum, steel, titanium. Additionally, cooling structure 118 may be coupled to surface 134 of seal slot 126 by any conventional mechanical coupling technique including, but not limited to, brazing, welding, mechanical fastening, adhesion, etc. As shown in FIG. 5, passageways 136 of cooling structure 118 may include a recess 142 on first surface 138 of body 132. More specifically, as shown in FIG. 5, passageway 136 of cooling structure 118 may include a recess 142 that may extend on first surface 138 substantially along a width (W) of body 132. Recess 142 may be formed on first surface 138 of body 132 by any conventional material recess technique, including, but not limited to, etching, milling, grinding, etc. In an alternative embodiment, recess 142 may be formed by adding material to first surface 138 of body 132 by any conventional material depositing technique including, but not limited to, casting, chemical deposition, direct metal sintering, or sputtering.

Figure 6:
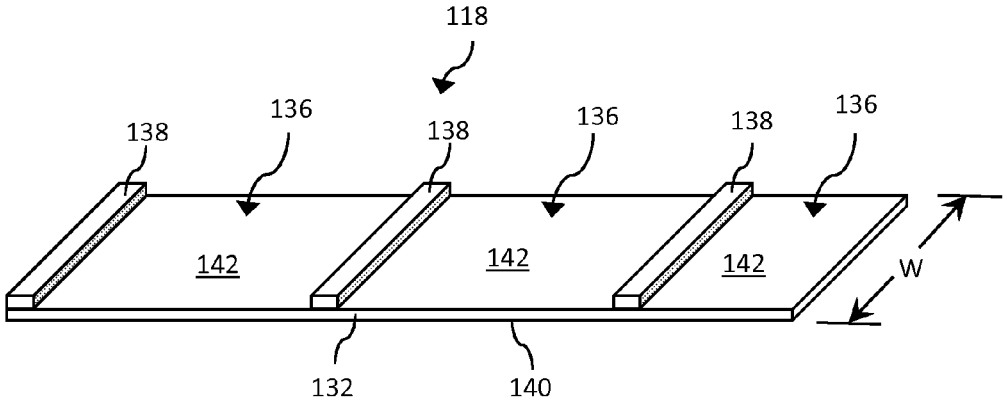
FIGS. 6-11 shows perspective views of various cooling structures, according to alternative embodiments of the invention.
Figure 7:
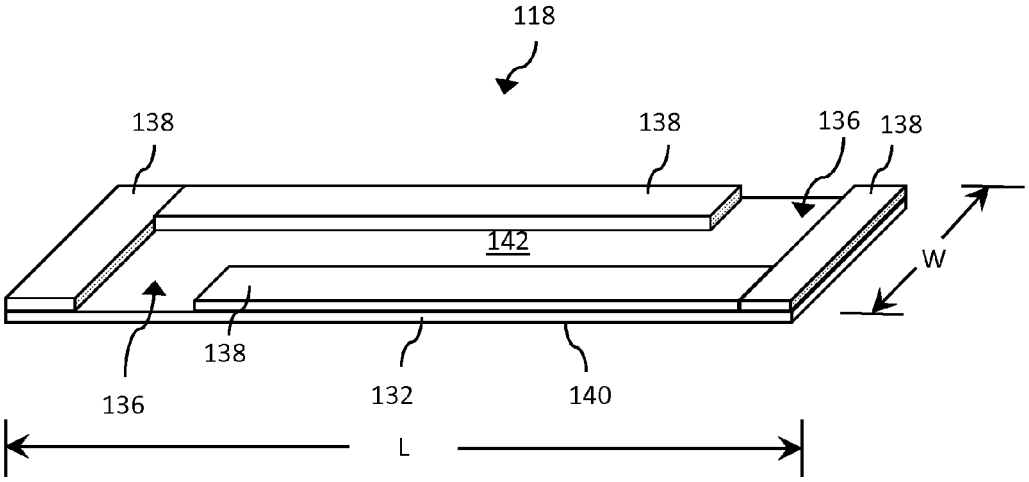
Figure 8:
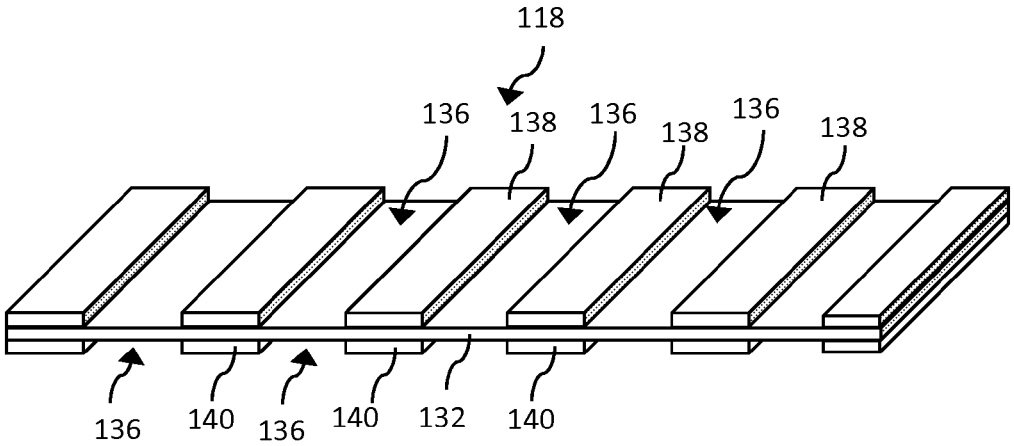
Figure 9:
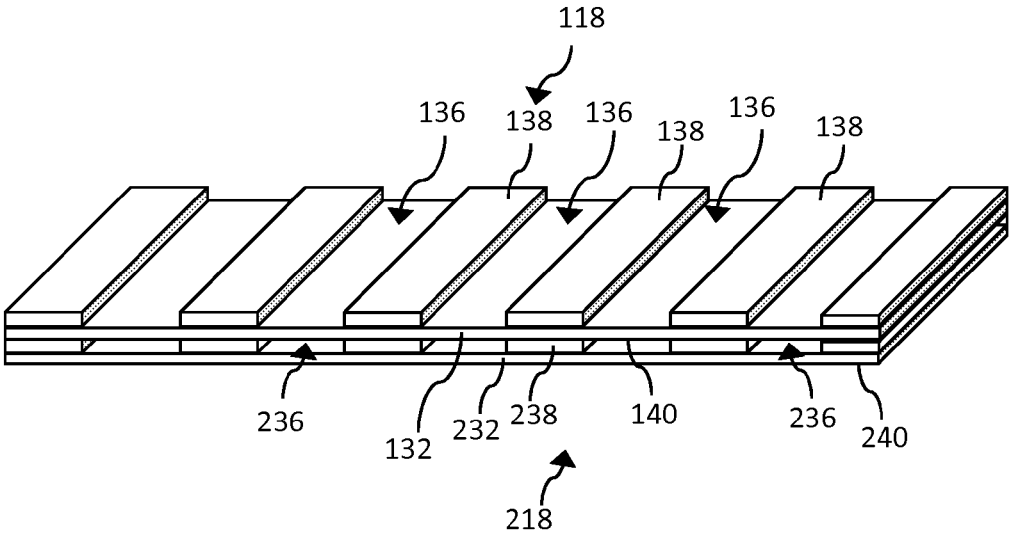

As shown in FIGS. 6-11, various alternative embodiments of cooling structures 118 are shown. More specifically, as shown in FIGS. 6-11, passageway 136 may include a variety of distinct configurations, widths, and/or positions on body 132 of cooling structure 118. As shown in FIG. 6, passageway 136 may span substantially along the width (W) of body 132. As observed by comparing FIGS. 5 and 6, the width of passageway 136 may vary. As shown in FIG. 7, passageway 136 of cooling structure 118 may extend on first surface 138 along a length (L) of body 132. Passageway 136 may extend along a length (L) of body 132 of cooling structure 118, and may discharge cooling fluid in a specific portion of seal slot 126 for providing optimum cooling fluid within seal slot 126. As shown in FIG. 8, passageway 136 may be formed on both first surface 138 and second surface 140 of body 132 of cooling structure 118. Passageway 136 formed on second surface 140 may also provide cooling fluid to seal slot 126 (FIG. 3) as discussed herein. Alternatively, as shown in FIG. 9, shroud 114 (FIGS. 2-4) may include a plurality of cooling structures 118, 218 positioned within seal slot 126 (FIGS. 2 and 3). As shown in FIG. 9, the plurality of cooling structures 118, 218 may be coupled to each other. More specifically, as shown in FIG. 9, second surface 140 of cooling structure 118 may be coupled to first surface 238 of distinct cooling structure 218. Distinct cooling structure 218 may include body 232, passageway 236, and second surface 240. In an alternative embodiment, cooling structures 118, 218 may be stacked.

Figure 10:
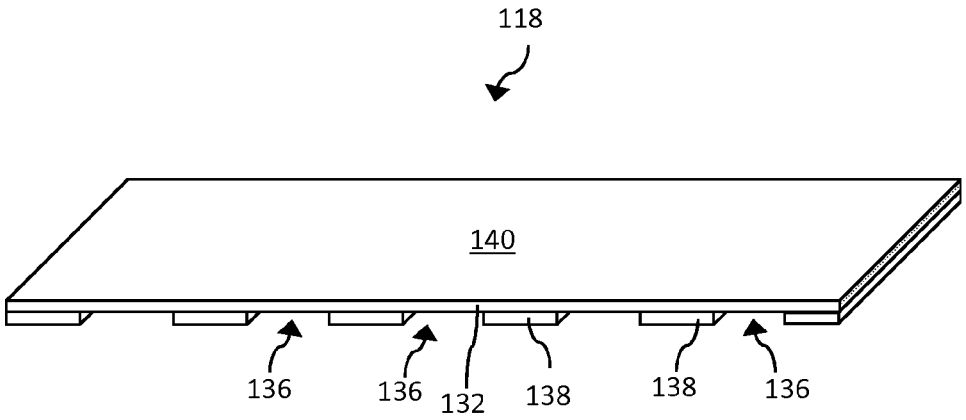
Figure 11:
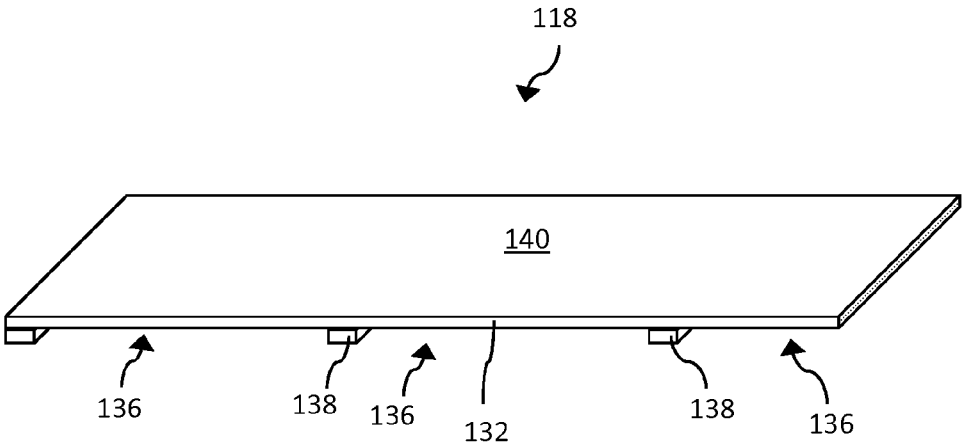
Figure 12:
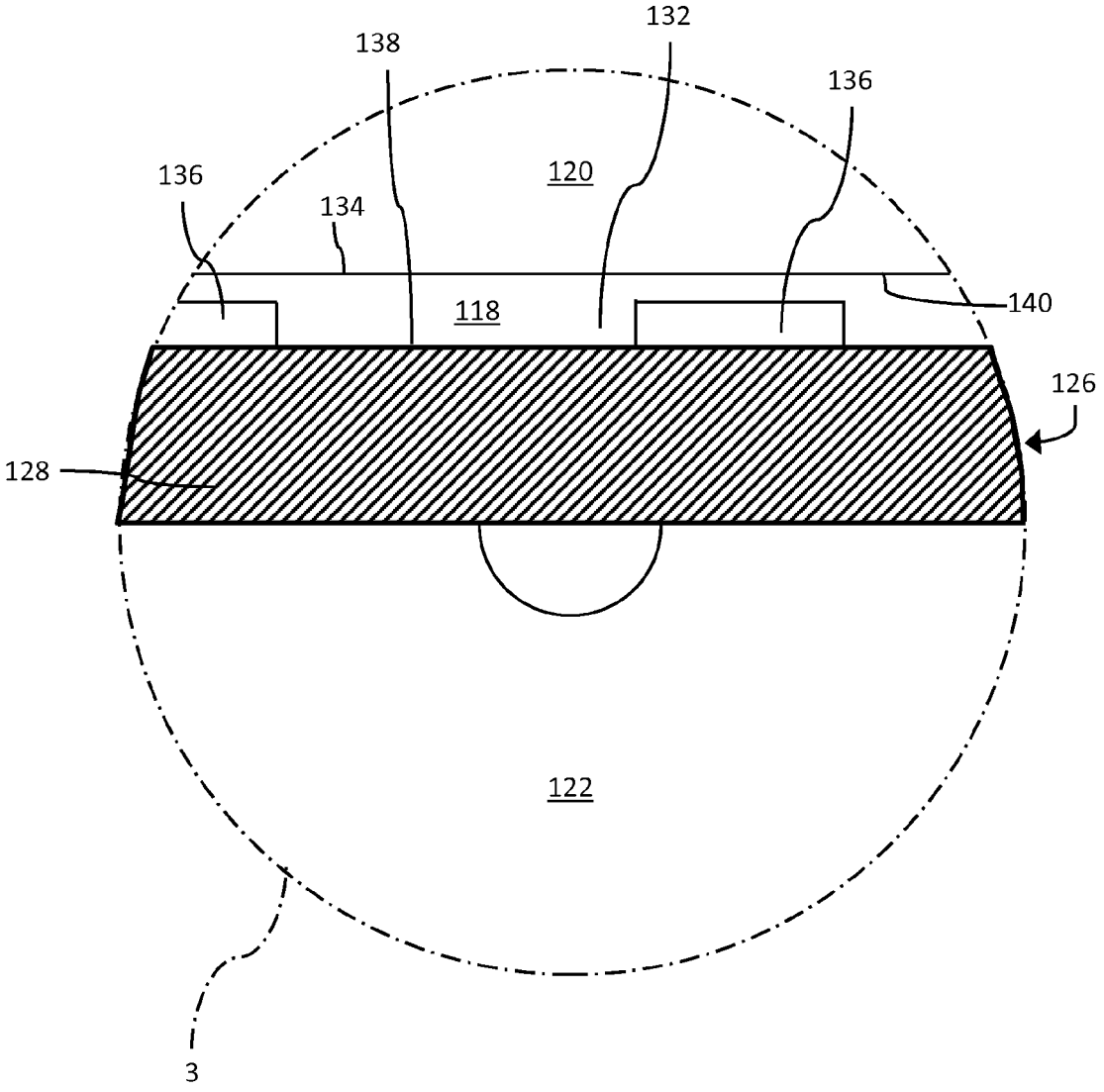
FIG. 12 shows an enlarged front view of a portion of the turbine shroud of the turbomachine in FIG. 2 including an alternative cooling structure and a seal, according to an alternative embodiment of the invention.

As shown in FIGS. 10-12, cooling structure 118 may be substantially rotated such that second surface 140 may face seal 128, and first surface 138 include passageway 136 facing away from seal 128. More specifically, as shown in FIG. 12, second surface 140 of cooling structure 118 may be coupled to surface 134 of seal slot 126 of shroud 114. First surface 138 of body 132 of cooling structure 118 may be positioned adjacent seal 128, and passageway 136 of cooling structure 118 may be formed between first surface 138 of body 132 and seal 128.

Figure 13:
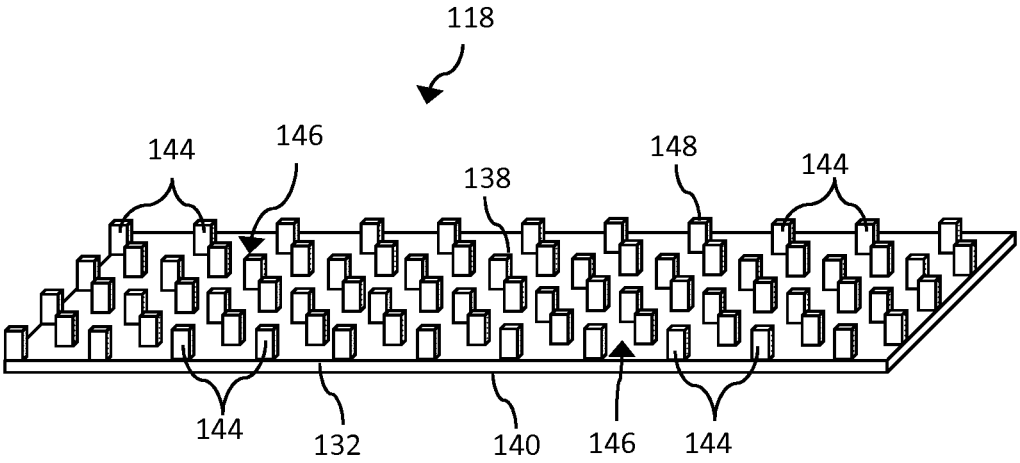
FIGS. 13 and 14 show perspective views of various cooling structures, according to alternative embodiments of the invention.
Figure 14:
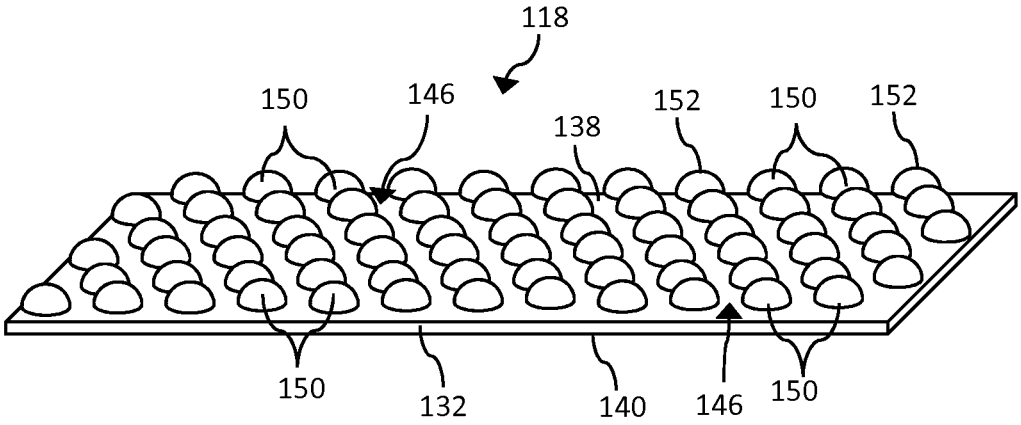

Turning to FIGS. 13 and 14, various alternative embodiments of cooling structure 118 are shown. More specifically, as shown in FIG. 13, cooling structure 118 may include a plurality of pins 144 extending from first surface 138 of body 132 of cooling structure 118. As shown in FIG. 13, each adjacent pair of the plurality of pins 144 may include an opening 146 therebetween. Opening 146 may be for providing cooling fluid to seal slot 126 (FIG. 2) during operation of gas turbine component 106 (FIG. 1), substantially similar to the passageway 136, as shown and described with reference to FIGS. 3-12. A top surface 148 of each of the plurality of pins 144 may be coupled to surface 134 of shroud 114 (FIG. 3) when positioning cooling structure 118 within seal slot 126 (FIG. 3). In a further alternative embodiment, as shown in FIG. 14, cooling structure 118 may include a plurality of raised members 150 extending from first surface 138 of body 132 of cooling structure 118. As shown in FIG. 14, each adjacent pair of the plurality of raised members 150 may include opening 146 therebetween. Opening 146 may be for providing cooling fluid to seal slot 126 (FIG. 2) during operation of gas turbine component 106 (FIG. 1), substantially similar to the passageway 136, as shown and described with reference to FIGS. 3-12. In this embodiment, an apex 152 of each of the plurality of raised members 150 may be coupled to surface 134 of shroud 114 (FIG. 3) when positioning cooling structure 118 within seal slot 126 (FIG. 3). Although shown as substantially spherical, the plurality of raised members 150 may take a variety of other shapes (not shown).

Figure 15:
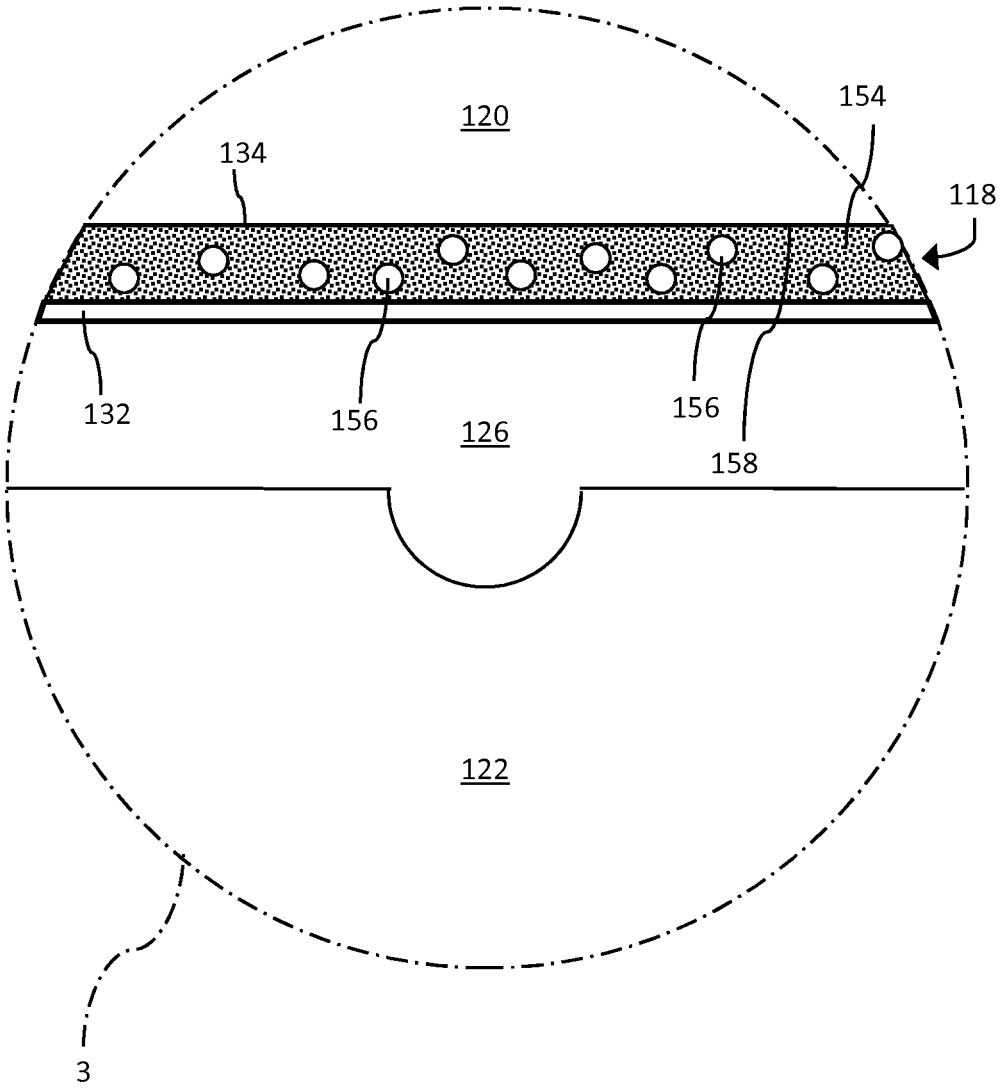
FIG. 15 shows an enlarged front view of a portion of the turbine shroud of the turbomachine in FIG. 2 include an additional cooling structure, according to an alternative embodiment of the invention.

Turning to FIG. 15, an enlarged front view of a portion of turbine shroud 114 (FIG. 2) is shown include a cooling structure 118 according to an alternative embodiment of the invention. More specifically, as shown in FIG. 15, body 132 of cooling structure 118 may include a substantially porous foam 154. As shown in FIG. 15, passageway 136 for providing cooling fluid to seal slot 126 may include an opening 156 in substantially porous foam 154. That is, opening 156 of substantially porous foam 154 may provide the cooling fluid to seal slot 126 during operation of gas turbine component 106 (FIG. 1). Substantially porous foam 154 may be coupled to body 132 of cooling structure 118 by any conventional mechanical coupling technique, including, but not limited to, brazing, welding, mechanical fastening, etc. In an alternative embodiment, not shown, substantially porous foam 154 may be independent of body 132 (e.g., standalone) and may be positioned within seal slot 126 by coupling surface 158 to surface 134 of seal slot 126. As shown in FIG. 15, a surface 158 of substantially porous foam 154 may be coupled to surface 134 of first component 120 of shroud 114. More specifically, surface 158 of substantially porous foam 154 may be coupled to surface 134 by any conventional mechanical coupling technique, including, but not limited to, brazing, welding, mechanical fastening, adhesion, etc. Substantially porous foam 154 may include any conventional foam including a substantial porous material (e.g., silicon, ceramic, etc.) capable of withstanding the high temperature of the hot gas of gas turbine component 106 (FIG. 1).

As discussed with reference to FIGS. 1-4, during the operation of turbomachine 100, hot gas is passed through gas turbine component 106 for driving and/or rotating the plurality of blades 112, and in part, shaft 108 for generating power using generator 110. In order to improve the operational efficiency of gas turbine component 106, shrouds 114 may be utilized within gas turbine component 106. As a result, hot gas is prevented from axially leaking from the hot gas flow path. However, seal slot 126 and seal 128 may be partially exposed to the high temperature hot gas. The exposure to the high temperature hot gas may undesirably degrade seal 128 and shroud 114 over time, and may require replacement and/or maintenance. By utilizing cooling structure 118 in seal slot 126, as discussed herein, cooling fluid flowing above first component 122 within housing 116 may flow to cooling structure 118, and more specifically, may flow through passageway 136 of cooling structure 118 to seal slot 126. By providing the cooling fluid to seal slot 126 via cooling structure 118, the seal slot 126, and in part, seal 128 may be cooled during exposure to the hot gas flowing through gas turbine component 106. The process of cooling seal slot 126 and/or seal 128 using cooling structure 118 may aid in minimizing the degradation rate of shroud 114 and/or seal 128.

Additionally, by utilizing cooling structure 118 within seal slot 126, a user (e.g., turbine operator) may select an amount of cooling fluid being provided to seal slot 126 of shroud 114. More specifically, cooling structure 118 may include customizable dimensions and/or quantity of passageway 136 formed on body 132 of cooling structure 118. As such, a desired amount of cooling fluid to be provided to seal slot 126 may be predetermined dependent on the characteristics of the turbomachine 100 (e.g., ambient temperature, size of turbomachine components, firing temperature, etc.), and cooling structure 118 may be created for specifically providing the desired amount of cooling fluid to seal slot 126. That is, by adjusting the dimensions and/or quantity of passageway 136 of cooling structure 118, the cooling fluid provided to seal slot 126 may be selected. Furthermore, by utilizing cooling structure 118 within shroud 114, a cooling fluid passageway (e.g., passageway 136, opening 156) may be implemented by turbomachine 100 quickly and inexpensively. More specifically, by utilizing cooling structure 118 within shroud 114, cooling fluid passageways are not formed during the casting process of shroud 114, which may be expensive, time consuming and may be inaccurate due to the narrow work space of seal slot 126 of shroud 114.

Figure 16:
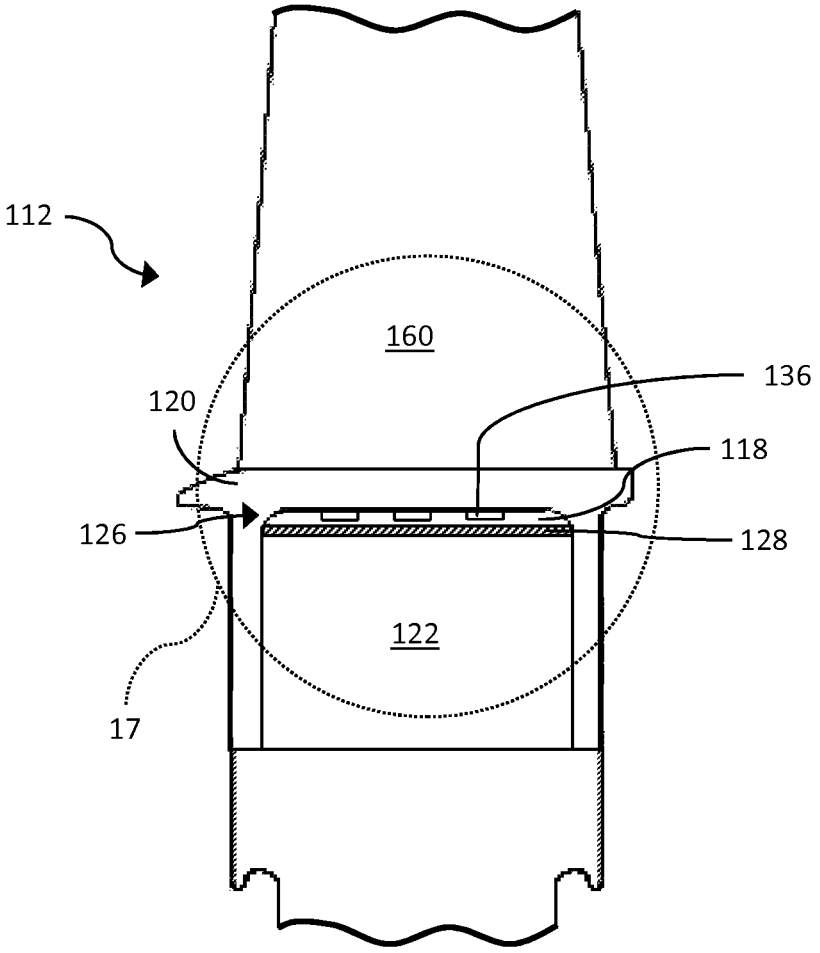
FIG. 16 shows a perspective view of a turbine bucket of a turbomachine including a cooling structure, according to embodiments of the invention.
Figure 17:
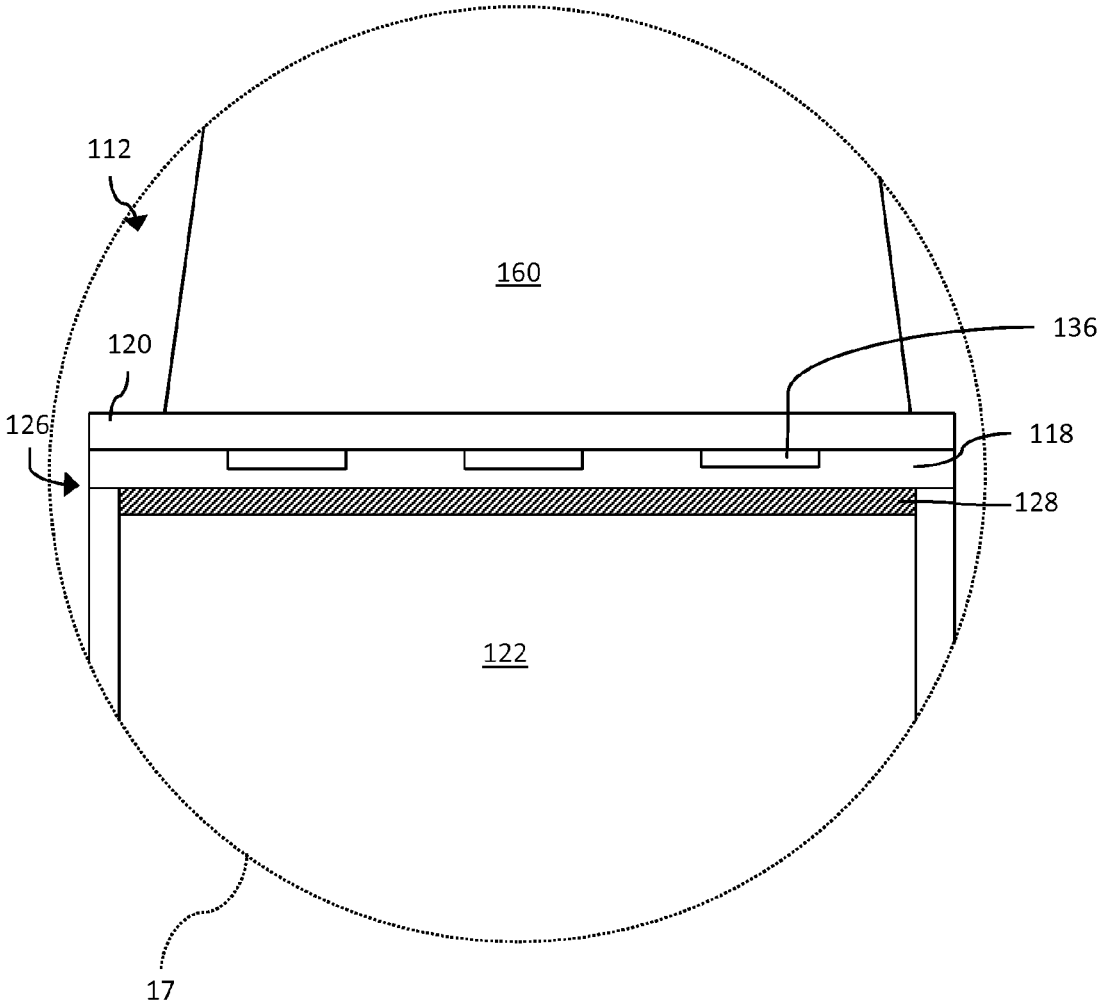
FIG. 17 shows an enlarged front view of a portion of the turbine bucket of the turbomachine in FIG. 16 including the cooling structure, according to embodiments of the invention.

Although cooling structure 118 is described as being implemented within shroud 114, it is understood that cooling structure 118 may be used by a variety of components of turbomachine 100. In an alternative embodiment, as shown in FIGS. 16-17, cooling structure 118 may be positioned on a bucket 112 of turbomachine 100 (FIG. 1) where a cooling passageway for providing cooling fluid may be beneficial. More specifically, as shown in FIGS. 16-17, bucket 112 of turbomachine 100 (FIG. 1) may include cooling structure 118 positioned in seal slot 126 between first component 120, and second component 122. As shown in FIG. 16, first component 120 may be configured as a platform for blade 160 of bucket 112, and second component 122 may be configured as a base portion of bucket 112, coupled to shaft 108 of turbomachine 100 (FIG. 1). Cooling structure 118, as shown in FIG. 16 may provide cooling fluid to the platform (e.g., first component 120), and base portion (e.g., second component 122) for preventing undesirable exposure to the hot gas. Seal 128 positioned within seal slot 126 of turbine bucket 112 may be positioned between two adjacent buckets 112 of turbomachine 100, and may substantially prevent hot gas from flowing toward the shaft 108 (FIG. 1), and may also prevent cooler gas surround shaft 108 from entering the hot gas path of turbomachine 100 (FIG. 1).

In a further alternative embodiment, not shown, cooling structure 118 may be positioned in seal slot 126 positioned between first component 120 and second component 122 on a plurality of stator nozzles positioned between each of the stages of the plurality of buckets 112 of turbomachine 100 (FIG. 1). Cooling structure 118 may be positioned in any conventional passageway of the stator nozzle that may benefit from receiving cooling fluid during operation of turbomachine 100 (FIG. 1). For example, cooling structure 118 may be positioned in seal slot 126 of the plurality of stator nozzles, where first component 120 includes a component configured to be mounted to a turbine housing shell and/or shroud 114 (FIG. 1), and second component 122 includes a platform for the stator vane/blade portion of each of the plurality of stator nozzles. In such an example embodiment, seal 128 may positioned within seal slot 126 between two adjacent stator nozzles of turbomachine 100, and may substantially prevent hot gas from flowing out of the hot gas path of turbomachine 100 (FIG. 1), and may also prevent cooler gas adjacent a turbine housing from entering the hot gas path of turbomachine 100 (FIG. 1). It is understood, however, that one skilled in the art may include cooling structure 118 and seal 128 in seal slot 126 of a variety of components in turbomachine 100 (FIG. 1) which may substantially benefit from being exposed to a cooling fluid, but may also require a seal to prevent undesirable leakage of the hot gas to/from the hot gas flow path of turbomachine 100 (FIG. 1).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbomachine comprising:
a plurality of buckets coupled to a rotor shaft; and
a turbine shroud separate from and positioned adjacent a tip of the plurality of buckets, the turbine shroud including:
a seal slot; and
a cooling structure positioned within the seal slot, the cooling structure having a body coupled to a surface of the seal slot, wherein the body includes a passageway on a first surface of the body for providing a cooling fluid to the seal slot, wherein the first surface of the body of the cooling structure is coupled to the surface of the seal slot,
wherein the passageway of the cooling structure includes a recess on the first surface of the body, wherein the cooling-structure is located entirely within the turbine shroud.

2. The turbomachine of claim 1, wherein the cooling structure further comprises a passageway on the second surface of the body for providing the cooling fluid to the seal slot.

3. The turbomachine of claim 1, wherein the first surface of the body of the cooling structure includes at least one of:
a plurality of pins extending from the first surface of the body, each adjacent pair of the plurality of pins having an opening therebetween, or
a plurality of raised members extending from the first surface of the body, each adjacent pair of the plurality of raised members having an opening therebetween.

4. The turbomachine of claim 1, wherein the passageway of the cooling structure extends on the first surface along a length of the body.

5. The turbomachine of claim 1, wherein the body of the cooling structure includes a substantially porous foam and the passageway includes an opening in the substantially porous foam for providing the cooling fluid to the seal slot.

6. The turbomachine of claim 1, wherein the cooling structure includes a pre-sintered preform.

* * * * *